US005443326A

United States Patent [19]

Bernard et al.

[11] Patent Number: 5,443,326

[45] Date of Patent: Aug. 22, 1995

[54] METHOD AND DEVICE FOR PROVIDING AN AQUATIC PASSAGE IN RUNNING WATER

[75] Inventors: Gilles P. Bernard, Annecy; Jean-Michel Tinland, Paris; Jean-Marie Dechaure, Curat; Pascal Simon, Annecy, all of France

[73] Assignee: Electricite De France, Paris, France

[21] Appl. No.: 94,112

[22] Filed: Sep. 13, 1993

[30] Foreign Application Priority Data

Jan. 31, 1991 [FR] France ..... 91 01105

[51] Int. Cl.[6] ..... E02B 3/02

[52] U.S. Cl. ..... 405/25; 405/21; 405/24; 405/52; 405/79; 472/13

[58] Field of Search ..... 405/24, 15–23, 405/2.5–3.5, 79; 472/13

[56] References Cited

U.S. PATENT DOCUMENTS 3,323,310 6/1967 Arpin ..... 405/24
4,534,675 8/1985 Morrisroe ..... 405/24

FOREIGN PATENT DOCUMENTS 390907 10/1908 France .
2635545 2/1990 France ..... 405/24
1813450 7/1969 Germany .
3519168 12/1986 Germany .
8811446 12/1988 Germany .
688986 4/1965 Italy ..... 405/24
9214001 8/1992 WIPO .

OTHER PUBLICATIONS

World Patents Index Latest, Section PG, Week 9039, Derwent Publication Ltd., London, GB; Class P36, AN 90–290576 & AU, D, 3,393,489 (GEBBIE) 1990.
European Search Report-PCT/FR 92/00082, SA 56647.

*Primary Examiner*—Dennis L. Taylor
*Attorney, Agent, or Firm*—Pearne, Gordon, McCoy & Granger

[57] ABSTRACT

A device for creating a specific but temporary aquatic passage in an artificial or natural river. The device includes bases which rest on the bottom of a river and elements which extend upwardly from the bases. The bases have holes formed therein which receive rods that extend downwardly from the elements. Placement of the bases in the river bed, and subsequent installation of elements into the bases, allows obstacles to be created in the river which are desirable for canoeing and kayaking.

16 Claims, 3 Drawing Sheets

METHOD AND DEVICE FOR PROVIDING AN AQUATIC PASSAGE IN RUNNING WATER

FIELD OF THE INVENTION

The invention concerns aquatic sports and activities, such as canoeing and wherein, rivers are used in which nautical stages are provided to allow for the teaching of sailing enthusiasts and the running of competitions.

BACKGROUND OF THE INVENTION

Water sports, and more particularly canoeing and kayaking, are a constantly growing leisure activity. To cope with this demand, several types of aquatic passages are used.

The first type is constituted by natural rivers offering a unique framework for sailing enthusiasts and which require little equipment or accessories, such as markers or beacons suspended above the river so as to subsequently lay out a specific passage or route in the bed of this river to be traversed.

A second type of aquatic passage is offered by pseudo-natural passages which are facilities of rivers with the aid of natural or concrete layers of broken stones. In fact, the bed of the river is modified by the creation of artificial volumes by means of concrete masses installed in the river bed.

A third type of aquatic passage is constituted by artificial rivers obtained by, for example, diverting one portion of the flow of a river into an artificial canal or by means of pumping water from a river or reservoir into an artificial canal.

These types of aquatic passages or courses only offer, for a specific river, a single determined immovable flowing path of the water of the river. In other words, the bed and the flow from the river are definitively fixed.

Moreover, the development of these nautical activities is such that these running water stages are the main driving elements required for carrying out these sports and in particular for canoeing and kayaking.

The object of the invention is to develop a nautical passage avoiding said drawbacks and able to offer the possibility of changing the course to be traversed within the river so as to diversify the possible passages to be made on this river, while avoiding modifying the overall river bed.

SUMMARY OF THE INVENTION

To this effect, one first main object of the invention concerns a method for providing a nautical course in running water and intended for nautical activities and consisting of modifying the river bed by placing or creating artificial volumes in the river bed. According to the invention, it consists of carrying out the following stages steps:

partially draining the river;

placing on the river bed, at each location where it is desired to create a volume, at least one base provided with holes opening on its upper surface;

placing inside the holes or bases each element having one portion going into these holes so as to constitute said artificial volumes, and refilling the river, so as to thus create a temporary nautical passage.

One improvement of this method consists of interconnecting several vertical elements by a linking piece so as to render them integral and define larger artificial volumes.

It is also possible to interconnect certain elements by an intermediate board so as to thus increase the artificial volumes created by these elements.

The second main object of the invention concerns a device to provide an aquatic passage in running water, especially for nautical sports, by modifying the bed of a river and including:

bases to be laid on the river bed, and elements secured to the bases and having one voluminous upper portion for constituting one portion of the artificial volumes in the river bed.

The bases, which may be made of concrete, are preferably have holes in the upper surface thereof and the elements each have a rod to fix them in said holes.

In this case, the holes are discharging and vertical with respect to the bases.

In this embodiment, the bases each have several depending feet so that the bases are elevated with respect to the river bed in order to provoke a circulation around and through the bases for the purpose of cleaning the holes.

The upper portion of certain elements may be constituted by a polyethylene casing molded around the rod 1 which extends over the entire height of the element, or a vertical cylinder with a lower rod being fixed to the base of said cylinder by means of a concrete sleeve.

Thus, it is possible to define the desired passage by firstly placing concrete bases at certain locations and equipping them with one or several vertical elements.

One preferred embodiment of the invention provides that the elements are each constituted by a vertical cylinder, itself constituting the upper portion where the lower rod is fixed by means of a concrete sleeve.

These cylinders are advantageously completed by forming handling orifices in the wall of each cylinder which allows the river water to flow into the cylinder when returning the water to the river and flow out of the cylinder when draining the river.

In this embodiment, each vertical element may be completed by a round cover or cap provided with at least one hole.

It is also possible to use multiple covers constituted by several round caps each provided with at least one hole so as to place on the top of several adjacent cylinders. Thus, larger volumes are created.

The cylinders and covers may be made of either polyvinyl chloride or polyethylene.

Preferably, the holes of the bases are lined with a sleeve preferably made of metal.

Preferably, the sleeve is provided with grooves on its internal surface.

Similarly, the rods preferably have longitudinal grooves.

Another feature of the invention consists in that the upper portions of certain elements are provided with grooves to receive upper intermediate planks placed between two elements and thus increasing the artificial volumes created by the elements.

BRIEF DESCRIPTION OF THE DRAWINGS

The invention and its characteristics shall be readily understood on reading the following detailed description of the preferred embodiments of the present invention with reference to the accompanying drawing, wherein.

DETAILED DESCRIPTION OF THE PREFERRED EMBODIMENTS

Figure 1:
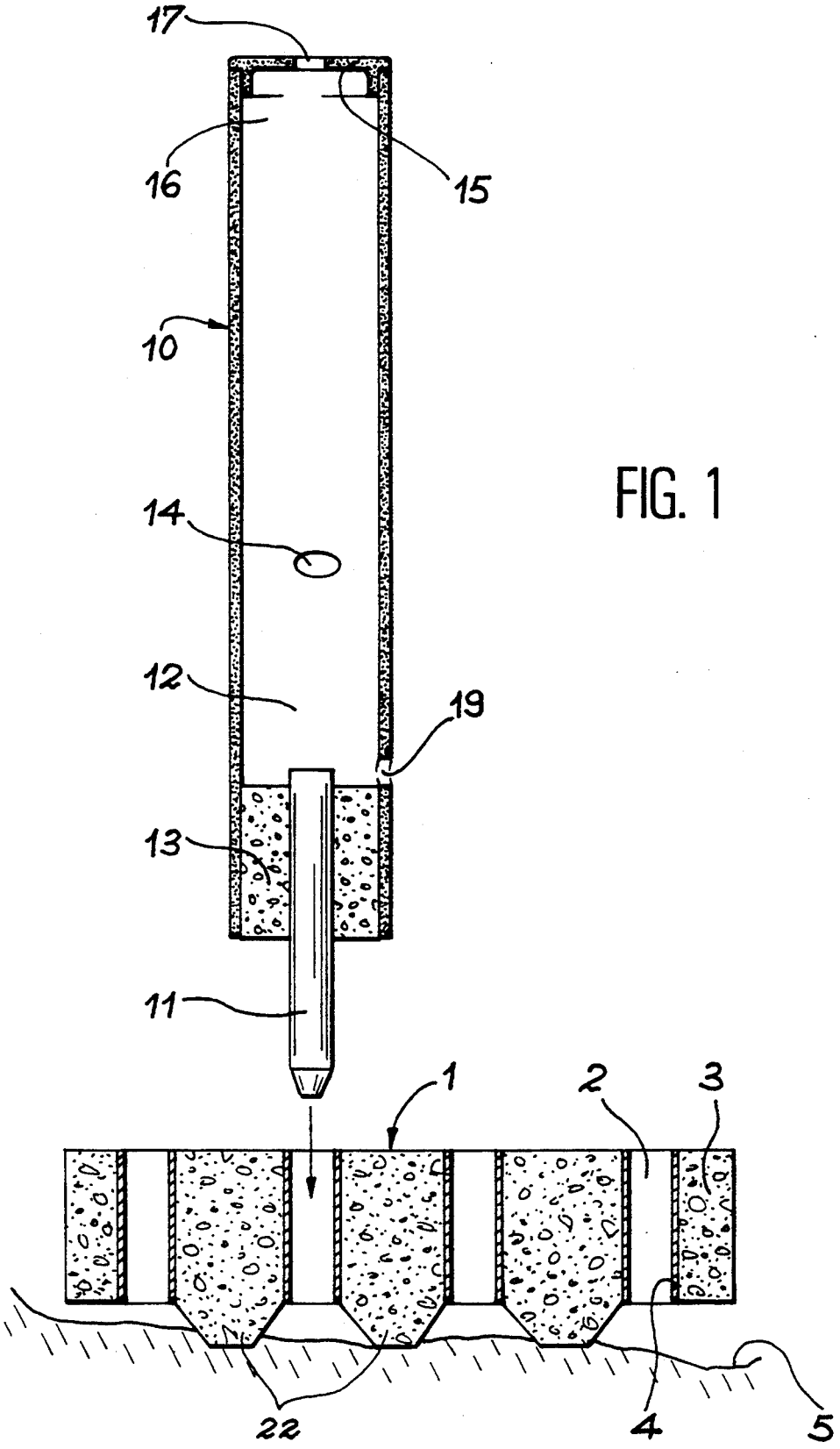
FIG. 1 is a sectional view of a first embodiment of one element and a base of the device of the invention.

With reference to FIG. 1, the main first portion of the device of the invention consists of creating a set of bases 1, preferably made of cement, and intended to be placed on the floor of the river bed 5, namely at the bottom of the latter. The main characteristic of these bases 1 is that they can be fixed above the elements 10 which shall constitute artificial volumes. As shown in the illustrated detailed embodiment, this is possible in that each base 1 has a set of holes 2, for example vertical and opening onto the upper surface 3 of the base 1 in question. The fact that these holes 2 are open at each end makes it possible to avoid any suction effect when an object is introduced or removed from these holes 2. They are preferably reinforced by a sleeve or sheath 4 which may, for example, be made of metal so as to increase their resistance to wear and ensure the lateral stability of the artificial volumes created in the river.

It is equally preferable to provide feet 22 underneath the bases 1 to support and elevate the base 1 from an underlying river bed 5. In fact, if said bases are surrounded by water, the current may allow for a systematic cleaning of the holes 2 when they are open, i.e. when elements 10 are not inserted therein.

It is therefore possible to consider using these bases 1 whose sides may vary, for example from 1 to 3 meters. Having regard to the fact that these bases 1 are preferably made of concrete, they typically need to be handled by means of a crane.

The second main element of the device of the invention is constituted by a set of elements 10, for example vertical elements, intended to establish an artificial volume in the river bed and able to divert or direct the flow of water of the latter. So as to be able to be fixed in a concrete base 1, the embodiment shown provides that each element 10 has at its lower portion a fixing rod 11 whose shape corresponds to the internal diameter of the sheath 4. In this respect, not only is the shape complementary to the internal shape of the sheath 4 (a cylindrical tube if the sheath 4 is cylindrical), but also all shapes may be inscribed there. Thus, it is possible to use cylindrical fixing rods 11 in the sheaths 4 whose internal shape is circular in which the external surface of the rods is inscribed.

In one first embodiment, and so as to facilitate the handling of this vertical element 10, the lower rod 11 may advantageously be embodied in the form of a hollow metallic profile. It is fixed to one upper portion 12 of the vertical element 10 which is hollow voluminous. In fact, the upper portion 12 constitutes the operational portion with regard to the flow of the river to be modified. The fixing of the lower rod 11 to the upper voluminous portion 12 may be advantageously effected with the aid of a linking concrete constituting a fixing sleeve 13. Thus, it is possible to equip, not merely any base 1 of one or several vertical elements 10 for constituting an artificial obstacle in the river bed, but also place this artificial obstacle at a desired location by placing the base 1 at the corresponding location at the bottom of the river.

Figure 2:
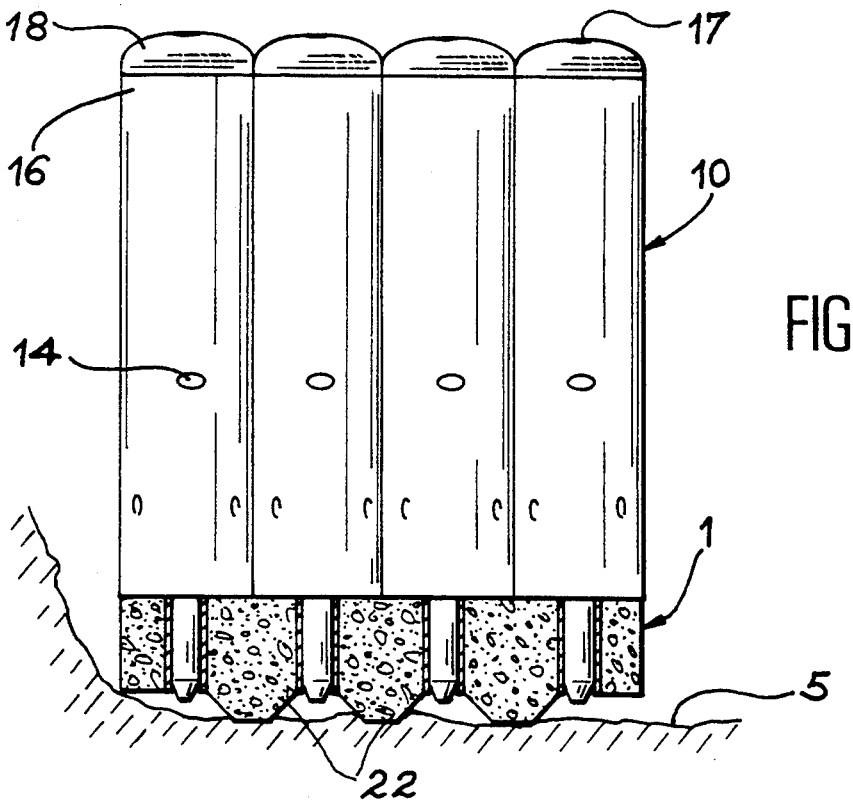
FIG. 2 is an elevated view of an assembly of several vertical elements constituting a determined volume.
Figure 3:
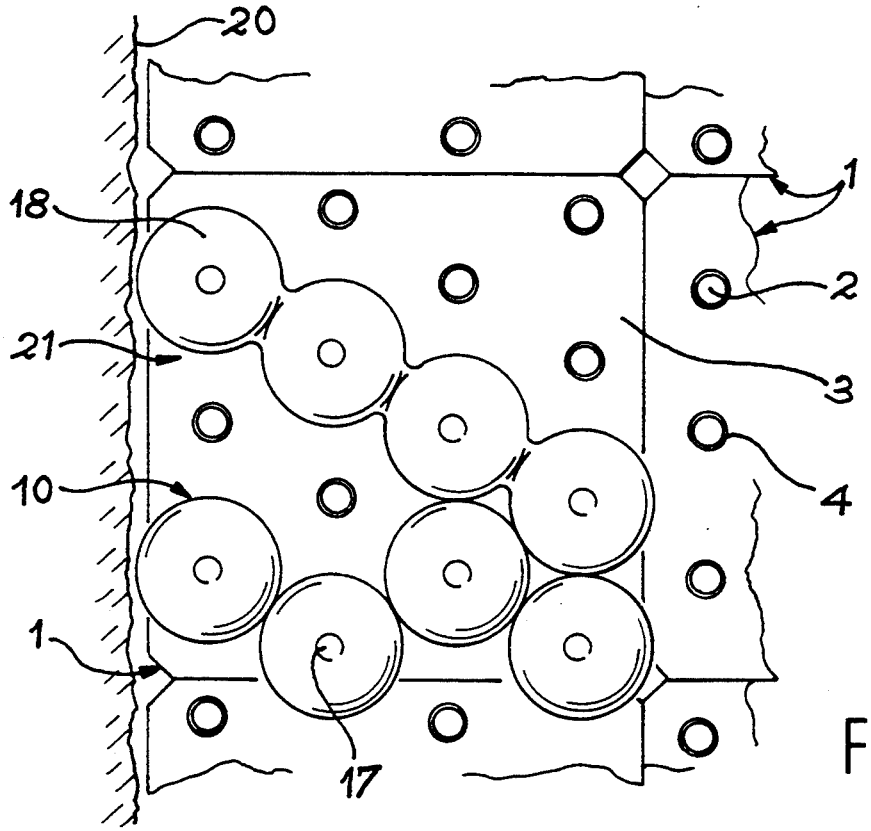
FIG. 3 is a top view corresponding to FIG. 2.

With reference to FIGS. 2 and 3, it can be immediately seen that the device of the invention is able to embody any type of artificial obstacle of any shape in the river bed, considering that the placing of bases 1 is possible on the bottom of said bed. In fact, FIG. 2 shows four vertical elements 10 placed beside one another. In effect, it is preferable that the distance between the holes 2 of the bases 1 corresponds to the diameter or width of the vertical elements 10. In this way, with them placed adjacently, these elements are able to play the role of a dike with respect to the water of the river.

FIG. 3 shows a top view of one possible embodiment of an obstacle shown by FIG. 2. In fact, in considering the edge 20 of the river, it can be seen that the placing of one or several bases on the side of the bed close to this edge 20 makes it possible to construct a projection 21 constituted by eight vertical elements 10 placed in such a way as to obtain the desired shape. Thus, a diversion of the flow of the river is created, that is an artificial turning.

The embodiment of FIG. 3 shows that the holes 4 are placed diagonally or zig-zag with respect to the edges 20 of the river bed. This is merely one embodiment example, the bases being able to be disposed anywhere, such as at the bottom of the river, and likewise the placing of the holes 2 in these bases 1 could be provided in any type of geometry. However, it is preferable that their position and spacing are able to constitute compact volumes. It can also be readily understood that if one or several bases 1 are placed in the middle of the river, it is possible to create, not merely a projection of the edge 20 of the river, but also an artificial island in the middle of the river bed.

With reference again to FIG. 1, for handling the vertical elements 10, at least one handling hole 14 is made in the wall of the upper portion 12 of the vertical elements 10. It is moreover advantageous that these holes 14 have a handle shape. Thus, the vertical elements 10 can be placed manually in the holes 2 of the bases 1 at the desired locations.

In this respect, it ought to be mentioned that the invention is preferably applicable to rivers able to be at least partially denuded of water, that is able to be significantly drained. Once the vertical elements 10 have been placed, the river may be filled with water. The handling holes 14 then enable the vertical elements 10 to remain in the bases 1 without floating. In fact, these fixing holes 14 allow water to progressively enter into each of the vertical elements. The embodiment of the lower rods 11 with the aid of hollow profiles allows for a possible circulation of water inside the vertical elements 10 below the bases 1 if the holes 2 do not open imperviously on the bottom 5 of the river. Finally, it is advantageous to provide a draining hole 19 in the bottom of the upper portion 12 so as to enable the water to flow out of the upper portion 12 when draining the river prior to any possible movement of the vertical element. This type of hole 19 may also be used as a handling hole once it has assumed the correct shape.

One first preferred embodiment of the upper portion 12 of the vertical elements 10 is of using relatively wide cylinders. These may in particular be PVC draining pipes, that is made of polyvinyl chloride or polyethylene.

These vertical elements 10 are each advantageously capped or completed by a round cover 15 placed at the top 16 of a vertical element 10. The cover 15 makes it possible to prevent users of the aquatic course from jamming a leg or arm in one of the vertical elements 10. Preferably, at least one hole 17 is provided traversing each of the covers 16 so as to allow air to escape during the gradual filling of the inside of the vertical elements 10 when water is placed back into the river.

In the case shown in FIGS. 2 and 3, it is advantageous to have a linking piece, such as a multiple cap 18 constituted by round individual covers rendered integral with one another. This multiple cap 18 is able to stiffen the structure created by means of several adjacent vertical elements 10.

Single or multiple covers may also be constituted by the same material as that of the upper portion 12 of the vertical elements 12, that is PVC or polyethylene.

The weight of this vertical element may then be about sixty kilograms for a length of between one 1.5 and 2 meters. These vertical elements 10 are able to resist a water level difference on opposite sides of the vertical element equal to one meter. Thus, it can be conceived that it is possible to set up local fast currents and deviations of the flow of the river so as to simulate obstacles and difficult situations on an aquatic course, such as rapids.

The above-discussed preferred embodiment of the invention provides that the lower rod 11 of the vertical elements 10 is a cylindrical rod and that the corresponding holes 2 are also cylindrical. This is merely one embodiment, these two elements being able to have different but corresponding shapes.

Similarly, the section of the vertical elements 10 need not be cylindrical but may be square or have a shape more suited to the configuration of the obstacle it is desired to create. In particular, they may have a shape complementary to the bank of the river opposite the location where they are placed so as to allow an obstacle to be in intimate contact with the latter and thus prevent the waler from flowing alongside the bank.

Figure 4:
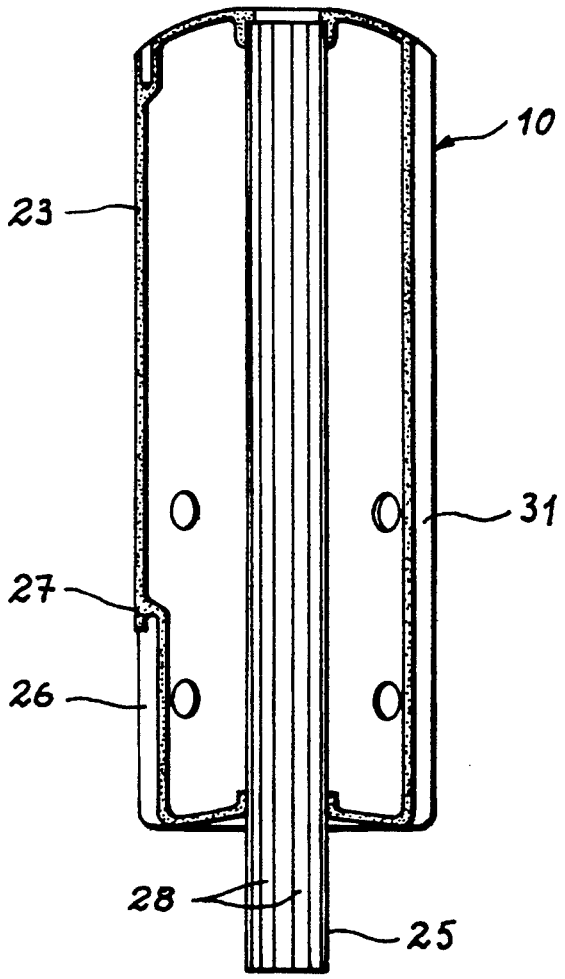
FIG. 4 is a second embodiment of one element of the device of the invention.

With reference to FIG. 4, a second preferred embodiment of the elements mainly consists of molding a synthetic material, such as polyethylene, around a large rod 25 extending over the entire height of the element. Thus, a vertical element 10 is formed having a casing 23 able to have any shape. Thus, it is possible to mold a large number of different obstacles so .as to obtain a relatively full set of obstacles for embodying a varied course.

In FIG. 4, the rod 25 is shown with longitudinal grooves 28. This may facilitate the introduction of rods 25 into the holes 2 or the sheath 3 of the holes when there is a small amount of dirt or sand inside these holes. This facility of mounting may also be obtained by making grooves on the internal surface of the sheaths 3 placed in the holes 2. So as to allow for handling of these elements 10, lower grooves 26 may be provided at the bottom of the polyethylene casing 23. Thus, it is possible to provide flanges 27 in the upper portion of these lower grooves 26 so as to form grasping handles.

Figure 5:
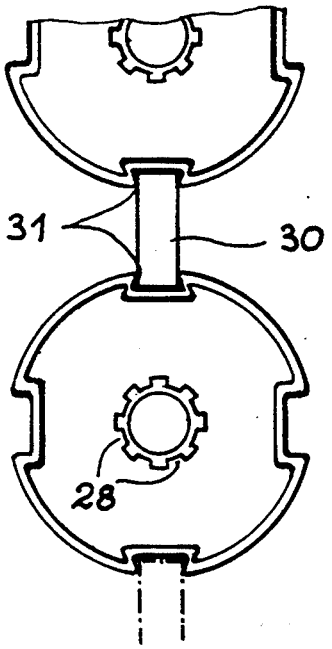
FIG. 5 is a top view using the elements of FIG. 4.

Secondly, with reference to FIG. 5, it is advantageous to make large longitudinal grooves 31 on one portion or over the entire height of several elements 10 so that an intermediate board 30 can be inserted therein. Thus, a link may be established between two elements 10 so as to offer additional possibilities for forming various obstacles. The intermediate boards 30 may have different heights so as to form a complete obstacle with regard to a boat or a sort of weir for provoking a rapid.

The method of the device of the invention makes it possible to have an open-ended structure able to be placed not only in running water but in a simple sheet of water. This running water stage using this type of obstacle offers a range of possibilities of variations of floats favorable to users. This type of equipment in fact is able to mitigate certain drawbacks appearing at a particular location, such as when the bed of a river provides a passage too difficult for users. On the other hand, it is also possible to create artificial difficulties in the bed of a river which normally does not present a major challenge for experienced users.

In addition, the obstacles can be moved, thus making it possible to vary the currents and movements of the water of a given river at a given location.

Moreover, the elements of the device may easily be standardized. However, the height of the vertical elements 10 may be extremely variable according to the water level of the river or the type of obstacle it is desired to create.

The aquatic courses created as above may possibly be accessible to water sports enthusiasts of all levels when they are associated with the flow variations of the river.

Finally, by virtue of its dismantable nature, the bases and elements can be removed from the river after use to restore the river to its initial natural bed. But it needs to be stated that in the last analysis, the invention is particularly fully adapted to the artificial river arms which have firstly been erected, for example in diverting any disposition installed on or at the edge of the river, such as a dam.

Other embodiments are possible, the concept of the invention residing in the fact of securing elements to bases placed at the bottom of the river to be converted.

What is claimed is:

1. Device for providing an aquatic passage in running water for nautical sports by modifying a rate and direction of water flowing within a river, comprising:

bases adapted to be removably placed on a bed of the river at predetermined locations, an upper surface of each base having a series of holes formed therein; and elements secured to the bases and comprising a rod and a voluminous upper portion, each of said rods being removably received by one of the holes in the bases and said upper portions defining artificial volumes in the river and modifying the rate and direction of water flowing within the river.

2. Device according to claim 1, wherein the bases are made of concrete.

3. Device according to claim 4, wherein the holes are vertical with respect to the bases and extend through said bases.

4. Device according to claim 3, wherein each of the bases include several depending feet which elevate the base with respect to the river bed in order to provoke a circulation of water around and through the bases for the purpose of cleaning the holes.

5. Device according to claim 1, wherein the upper portion of said elements is constituted by a polyethylene casing molded around the rod, said rod extending the entire height of the element.

6. Device according to claim 1, wherein the upper portion of said elements is constituted by a cylinder, said cylinder being secured the rod by means of a concrete sleeve.

7. Device according to claim 5, wherein the upper portion of each vertical element is equipped with handling holes which allow water to flow into and out of the cylinder.

8. Device according to claim 6, further comprising a round cover for each cylinder, said cover having at least one hole formed therein.

9. Device according to claims 6 or 8, further comprising a cover for placement on adjacent cylinders and constituted by several caps, each of said caps being provided with at least one hole.

10. Device according to claim 8, wherein the cylinders and covers are made of PVC.

11. Device according to claim 8, wherein the cylinders and covers are made of polyethylene.

12. Device according to claim 1, wherein the holes of the bases are lined with a sheath.

13. Device according to claim 12, wherein the sheath is metallic.

14. Device according to claim 12, wherein grooves are provided on an inner surface of the sheath.

15. Device according to claim 1, wherein the rods have longitudinal grooves formed thereon.

16. Device according to claim 5, wherein the upper portions of said elements have grooves for accommodating intermediate boards, said boards being placed between adjacent elements and thus increase the artificial volumes created by the elements.

* * * * *

UNITED STATES PATENT AND TRADEMARK OFFICE

CERTIFICATE OF CORRECTION

PATENT NO. : 5,443,326

DATED : August 22, 1995

INVENTOR(S) : Bernard et al.

It is certified that error appears in the above-identified patent and that said Letters Patent is hereby corrected as shown below:

Title page, item [75], inventor(s) delete "Curat" insert -- Cuvat --.

Column 1, line 48, delete "bed" and insert --flow--;

line 62, after "placing" insert --elements--; and
line 62, after "bases" insert --,-- (comma).

Column 2, line 26, delete "1" and insert --,-- (comma).

Column 3, line 36, after "examples" insert --,-- (comma); and
line 59, after "hollow" insert --or--.

Column 5, line 18, delete "one" and insert --about--; and
line 39, delete "waler" and insert --water--.

Signed and Sealed this

Fourteenth Day of May, 1996

Bruce Lehman

*Attest:*

BRUCE LEHMAN

*Attesting Officer*

*Commissioner of Patents and Trademarks*